US005897019A

United States Patent [19]

Stropkay

[11] Patent Number: 5,897,019

[45] **Date of Patent: *Apr. 27, 1999**

[54] FRUSTROCONICAL BEVERAGE CUP AND FITTED LID

[75] Inventor: Scott Stropkay, Carlisle, Mass.

[73] Assignee: Dunkin' Donuts Incorporated, Randolph, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 08/647,422

[22] Filed: May 13, 1996

[51] Int. Cl.[6] ..... A47G 19/23; B65D 21/02

[52] U.S. Cl. ..... 220/713; 206/519; 220/669; 220/791; 220/902

[58] Field of Search ..... 220/703, 711, 220/712, 713, 714, 716, 717, 799, 800, 801, 669, 675, 902, 254, 780, 789, 791, 793; 229/400, 404; 206/519, 520

[56] References Cited

U.S. PATENT DOCUMENTS

| | | | |
|---|---|---|---|
| 3,438,533 | 4/1969 | Hanisch et al. | 220/716 X |
| 4,127,187 | 11/1978 | Smith | 229/404 X |
| 4,146,157 | 3/1979 | Dixon, Sr. et al. | 220/717 X |
| 4,299,100 | 11/1981 | Crisman et al. | 220/903 X |
| 4,586,625 | 5/1986 | Garrett | 220/712 X |
| 4,627,537 | 12/1986 | Rogers | 220/712 X |
| 4,782,975 | 11/1988 | Coy | 220/711 |
| 5,111,961 | 5/1992 | Van Melle | 220/712 |
| 5,197,624 | 3/1993 | Dodaro | 220/712 X |
| 5,253,780 | 10/1993 | Adado | 220/711 |
| 5,419,436 | 5/1995 | Powell | 206/519 |
| 5,427,269 | 6/1995 | Willbrandt | 220/669 |
| 5,553,731 | 9/1996 | Schuyler | 220/713 X |

FOREIGN PATENT DOCUMENTS

| | | | |
|---|---|---|---|
| 0070950 | 9/1959 | France | 229/404 |

*Primary Examiner*—Stephen Castellano
*Assistant Examiner*—Niki M. Eloshway
*Attorney, Agent, or Firm*—Weingarten, Schurgin, Gagnebin & Hayes LLP

[57] ABSTRACT

A tapered cup having an outwardly rolled lip includes a cup wall having an upper portion that is outwardly flared more than an adjacent lower wall portion. The cup can include a groove below the outwardly rolled lip in the inner face of the cup wall. The cup can be provided with stacking ribs within the cup to aid in stacking of two or more cups. The cup can include a tapered lid with an outwardly flared lip that seats against the inner wall of the cup and that does not extend over the lip of the cup. The lid can include a locking ring below the outwardly flared lip of the lid that is adapted for insertion into the groove in the cup. The lid further includes a fluid port.

18 Claims, 19 Drawing Sheets

30
32
28
24
22
36
34
26
20
12
10
18
14
16

FRUSTROCONICAL BEVERAGE CUP AND FITTED LID

FIELD OF THE INVENTION

The invention relates to covered drinking vessels, and more particularly to disposable cups and lids.

BACKGROUND OF THE INVENTION

Paper cups, plastic cups, insulated cups, and the like, with and without covers, are not new. However, cups configured to meet the particular demands of a high-volume, rapid-response service establishment, fast-food restaurant, or coffee shop are unknown. These establishments have very specific requirements related to cups and lids with respect to lid storage and inventory control; beverage preparation and distribution; consumer safety and satisfaction; and cost containment. The following examples illustrate some of the deficiencies of presently known cups and lids.

A typical establishment stores thousands of cups. The cups are typically packaged and stored in nested stacks which are easily compressed even when properly stored and handled. Thus, one or more cups in each stack bind to adjacent cups and become difficult to separate. Sometimes a stack of cups becomes so severely compressed that cups are damaged. A stack of bound cups is usually provided to a beverage server for use. When the stack is depleted it is augmented by another stack of cups. The beverage server not uncommonly has to use two hands to remove a cup from the stack. Frequently, more than one cup is removed from the stack and must be replaced. This is not only inconvenient, but it can also severely slow down service, thereby frustrating queued patrons. Known cups do not provide features that protect cups from stacking related damage nor facilitate easy and sure removal of a single cup from a stack. Similarly, known lids can be difficult to store and access. For example, like cups, stacked lids can compress, rendering it difficult to extract a single lid from a stack.

Having a single cup in hand, the beverage server must accurately fill the cup with a predetermined volume of liquid, cover the cup with a lid, and render the covered cup to a patron. The speed and accuracy with which this operation is performed has a significant impact on profitability and customer satisfaction. Known lids are commonly difficult to properly position, snap, and seal on a cup.

Significant problems related to cups are also attendant to the service of hot beverages such as coffee, especially in a "drive-thru" setting. For example, it is difficult for a vehicle operator to tear off or tear back and secure a tab on the lid of the cup, while driving, to be able to drink the coffee. Furthermore, once an opening has been made in the lid, coffee from a filled cup can slosh out of the opening. In this context it would be desirable to provide a disposable coffee cup that is easy to drink from without making a mess. Known disposable cups do not meet these needs.

Additionally, as known thin-walled paper and plastic cups can be too hot to handle for a while after being filled, customers and beverage servers commonly nest two or more cups together to provide insulation. This is undesirable as it decreases profit margin and increases trash volume; but it also makes a filled cup increasingly unstable or tipsy as each additional cup is added for insulation. On the other hand, well-insulated styrofoam cups are also known. These foam cups, however, are so radially unstable that they easily deform when held. Therefore, when a foam coffee cup is full, simply grasping the cup can cause coffee to squirt out of the lid. Although it is possible to fabricate a very thick and therefore stable cup, such a thick cup is not only awkwardly sized, shaped, expensive, and wasteful, but it is also not pleasant to drink from and it does not let enough heat pass through the wall of the cup to provide an indication that the contents of the cup are hot.

Known disposable cups are typically mated with a lid that snaps over the top rim of the cup. In addition the difficulties recited above with respect to the pull-back and lock type tabs, these lids are undesirable for other reasons. For example, known lids cover the lip of the cup and often include a radially projecting annular flange of thin, sharp plastic that does not provide a pleasant lip feel. Additionally, known lids are not easily seated on the lip of the cup and readily pop-off when the walls of the cup are flexed. This is particularly problematic with respect to easily deformed foam cups. Furthermore, as one attempts to suck hot liquid through the hole in the lid, the nose is firmly pressed against the lid and into puddles of coffee retained in pockets on the lid. Although this discomfort could be eliminated by removing the lid from the cup, so that it is possible to drink naturally, it is well recognized that one almost never removes the lid from a cup of hot coffee in a moving vehicle. Finally, until the first inch or so of not coffee is slurped out of the cup, there is a risk of getting splashed with coffee even from a cup with a lid after the pull-tab is removed from the lid.

In sum, none of the known lid and cup combinations provide the pleasant sensation of drinking from a comfortably warm, smooth-lipped ceramic mug with the convenience and disposability of foam cup and plastic lid combinations; nor do the known cup and lid combinations address the service and safety requirements of the fast-food world. Thus, there is still room for improvement of the venerable cup.

SUMMARY OF THE INVENTION

The present invention overcomes the deficiencies of known disposable cup and lid combinations by providing a cup and lid combination which has superior insulating properties; is comfortable, safe, and clean to hold when filled with hot liquid; is easy to drink from; is structurally sound; is not readily collapsed; is easy to store; and is easy to manipulate.

In a first embodiment, a cup includes a resilient, hollow, frustroconical body open at a first end and closed at a second end. The first end has a greater diameter than the second end, and the body includes a wall having an inner face and an outer face. The wall extends from the first end to the second end of the body and has an outwardly rolled lip at the open first end. An upper portion of the cup has a more pronounced flare or taper than a lower portion of the cup. The cup can include a groove below the outwardly rolled lip in the inner face of the cup wall in a region proximate the upper and lower cup portion junction. The cup can also include stacking ribs that increase the diameter of the cup at one or more localized regions within the cup.

In another embodiment, the cup is combined with a lid. The lid includes a resilient, hollow, frustroconical body open at a first end and closed at a second end, wherein the first end has a greater diameter than the second end. The body includes a wall having an inner face and an outer face. A wall extends from the first end to the second end, and it has an outwardly flared lip at the open first end. A locking ring can be provided below the outwardly flared lip, wherein the locking ring is adapted for insertion into the groove of the cup. The closed second end of the lid defines a fluid port. The lip of the lid has a diameter that is less than the diameter of the open first end of the cup.

DESCRIPTION OF THE DRAWINGS

The invention will be more fully understood from the following detailed description taken in conjunction with the accompanying drawings in which.

DETAILED DESCRIPTION OF THE INVENTION

Figure 1:
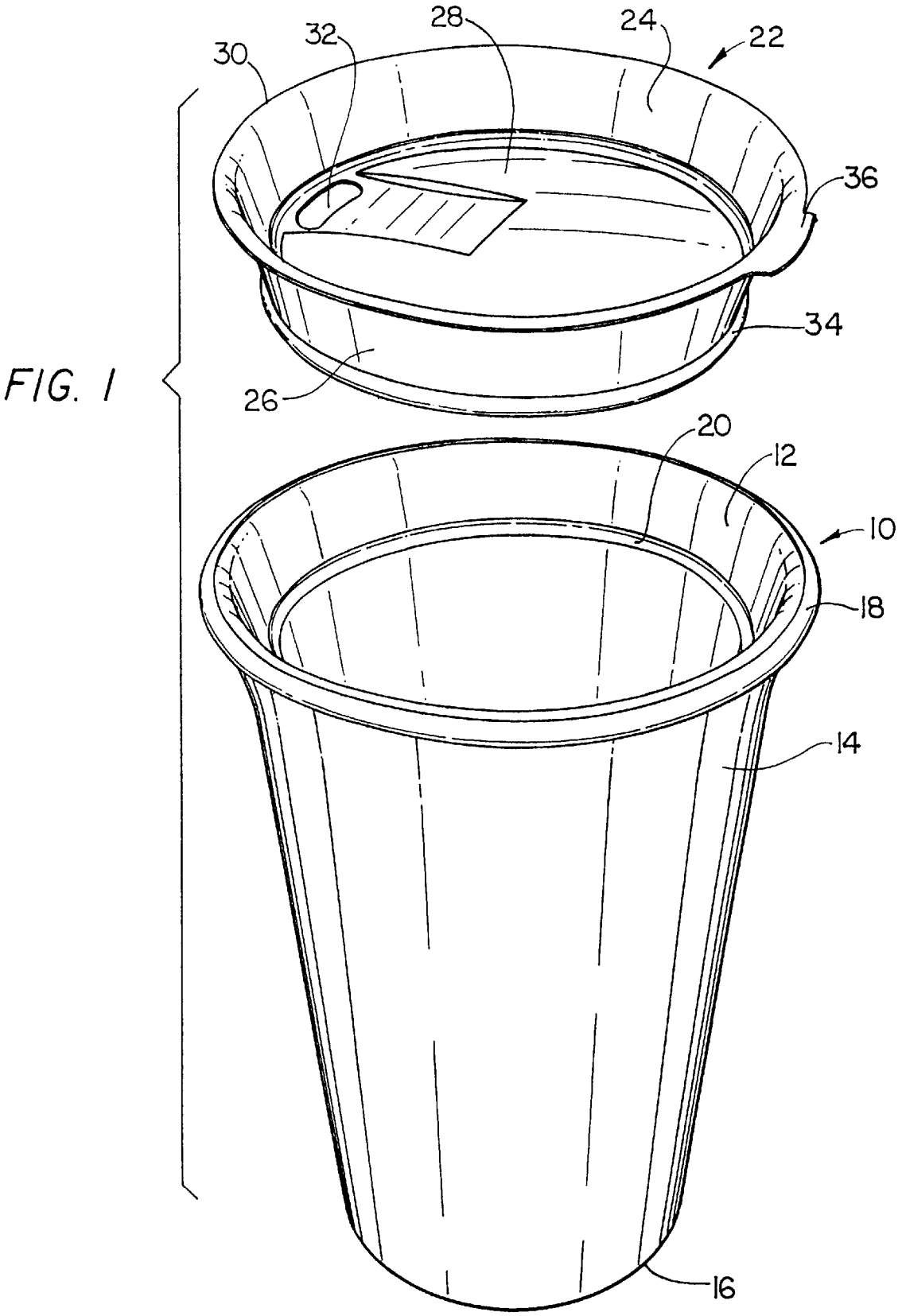
FIG. 1 is a perspective view of a cup and lid in accordance with the invention.

FIG. 1 illustrates a cup and lid combination or assembly in accordance with the invention. The cup and lid combination is shown in an exploded view or separated to illustrate features of each. The cup 10 is a hollow, tapered, frustroconical body having a wall with an inner face 12 and an outer face 14, a closed bottom a or base 16, and an open mouth defined by an outwardly rolled lip 18 at the free end of the cup wall. The outwardly rolled lip 18 may also be described as a beaded lip. The mouth of the cup has a larger diameter than the base of the cup.

The cup 10 further includes a circumferential recess, indent, or groove 20 subjacent the lip 18 of the cup. Although the groove 20 is shown as a single, uninterrupted recess, the groove can include several similar recesses vertically along the inner face 12 of the cup and/or several interrupted recesses in the same plane.

The wall of the cup, although continuous, can be described as having two region or portions, wherein a first portion extending from the base 16 to a point proximate the groove 20 has a first angle of taper or divergence with respect to an axis normal to the base, and a second portion extending from the point proximate the groove 20 to the lip 18 of the cup has a second angle of taper or divergence with respect to an axis normal to the base. The second angle is greater than the first angle and the second portion of the cup is distinctly flared with respect to the first portion. This flaring provides advantages as set forth below.

Associated with the cup 10 is a lid 22. The lid 22 is a hollow, tapered, frustroconical body having a wall with an inner face 24 and an outer face 26, a closed bottom or base 28, and an open mouth defined by an outwardly flared lip 30 at the free end of the lid wall. The lid defines a fluid port 32 that is a simple opening through the base 28 in this embodiment. The lid can further include a locking ring 34 on the outer face 26 of the lid wall or integral with the wall of the lid and which is adapted to be recessed within the groove 20 in the inner face 12 of the cup wall. Although the locking ring 34 is shown as a single, uninterrupted structure, the locking ring can include several similar structures vertically along the outer wall 26 of the lid and/or several interrupted structures in the same plane. The wall of the lid and the lip 30 are contoured to match the taper of the second portion of the cup wall and the curvature of the lip of the cup. A tab 36 can be provided on the lid 22.

In the illustrated embodiments the cup 10 is fabricated from beaded foam and the lid 22 is plastic. Both the cup 10 and the lid 22 are slightly resilient so that when the lid is pushed into the cup and the locking ring 34 on the lid is aligned with the groove 20 in the cup, the locking ring seats within the groove. The outer face 26 of the lid is pressed against the adjacent inner face 12 of the cup and the lip 30 of the lid presses against the lip 18 of the cup. The locking ring 34 and groove 20, the flaring of the second portion of the cup with respect to the first portion of the cup, and the nested lips 30 and 18, prevent the lid 22 from being inserted into the cup 10 other than a preselected distance, unless force which would damage or severely deform the lid and/or cup is applied to the lid. Thus, the lid 22 is able to be quickly and properly positioned within the cup 10 to provide a fluid-tight seal, wherein the only outlet for a liquid within the cup is through the fluid port 32 in the lid.

Figure 2:
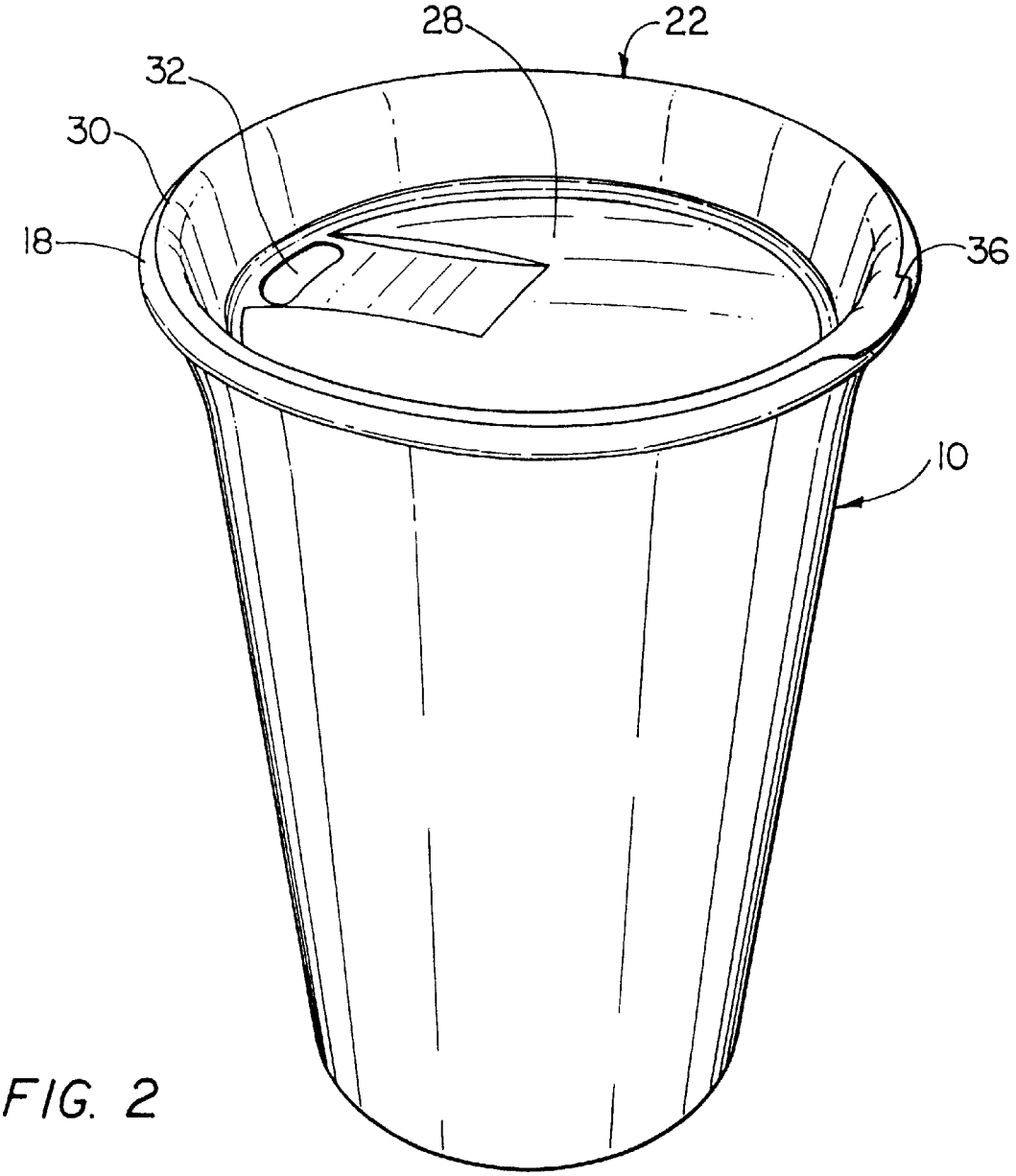
FIG. 2 is a perspective view of the cup and lid shown in a mated condition.

Referring now to FIG. 2, the lid 22 and the cup 10 are shown in a mated relationship. In this view it will be noted that the lip 18 of the cup which is normally exposed to the lips of a person drinking from the cup 10 is not covered by any portion of the lid 22 except along the inner face of the cup. The edge of the lip 30 of the lid is recessed or within the confines of the mouth of the cup and is sufficiently thin so as to be virtually unnoticeable to one drinking from the cup 10. Also, it should be noted that the base 28 of the lid is depressed well below the mouth of the cup to allow a person to drink naturally from the cup 10. The combination of the recessed base 28 and the unencumbered cup lip 18 provides for a drinking experience that is similar to drinking from a cup without any lid, while preserving the safety and cleanliness advantages of a lid. Additionally, the recessed lid 22 reinforces the cup and increases its rigidity to provide a satisfying, solid drinking area or surface. With respect to a beaded foam cup which is radially unstable, a recessed lid in accordance with the invention and the lip roll of the cup are particularly important in providing radial stability and a solid feel.

Another advantage of positioning the base 28 of the lid below the plane defined by the mouth of the cup is that the possibility of seriously overfilling the cup 10 is eliminated. Initially, the locking groove 20 on the inside of the cup provides a visual indication of the fill level to an individual pouring coffee into the cup. Were this level to be exceeded, coffee would exit the fluid port 32 when the lid 22 is inserted into the cup 10, and then be poured off by the beverage server. If the cup 10 is handed to another individual and some of the liquid sloshes out of the fluid port 32, there is ample reserve within the depressed lid below the mouth of the cup to prevent the coffee from spilling from the cup. In an exemplary embodiment, the base 28 of the lid is ¼ to 1 inch below the mouth of the cup.

In addition to the above safety features, the lid 22 can be provided with a contoured base 28, as shown in this illustration and described hereinbelow with respect to other figures, that urges coffee that has exited the fluid port 32 back into the portion of the cup below the base. It should also be noted that with the exception of the tab 36, there is virtually no surface which extends from the lid 22 beyond the lip 18 of the cup and which could be inadvertently grasped or snagged thereby loosening the lid. Even if the lid 22 were to become dislodged, the lid is readily reseated within the cup 10, and the person seating the lid receives both a tactile and an audible "click" or indication of cup/lid engagement. Furthermore, because the lid seats within the cup, and not over the top of the lip of the cup, it is quite apparent visually when the lid is not properly seated.

Figure 3:
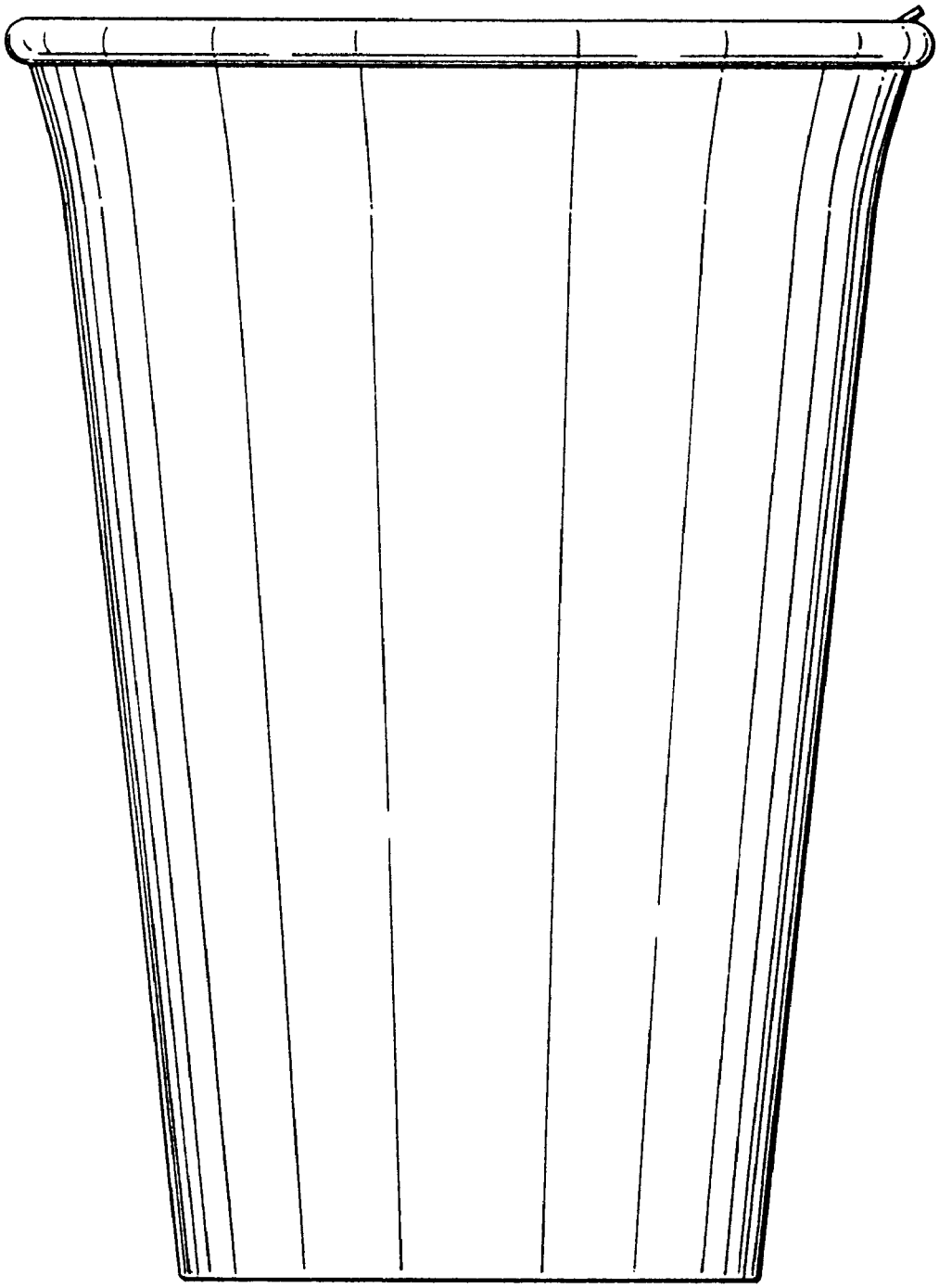
FIG. 3 is a side view of the cup in FIG. 1.

FIG. 3 is a side view of the cup of FIG. 1, wherein the flaring of the second portion of the cup with respect to the first portion is apparent.

Figure 4:
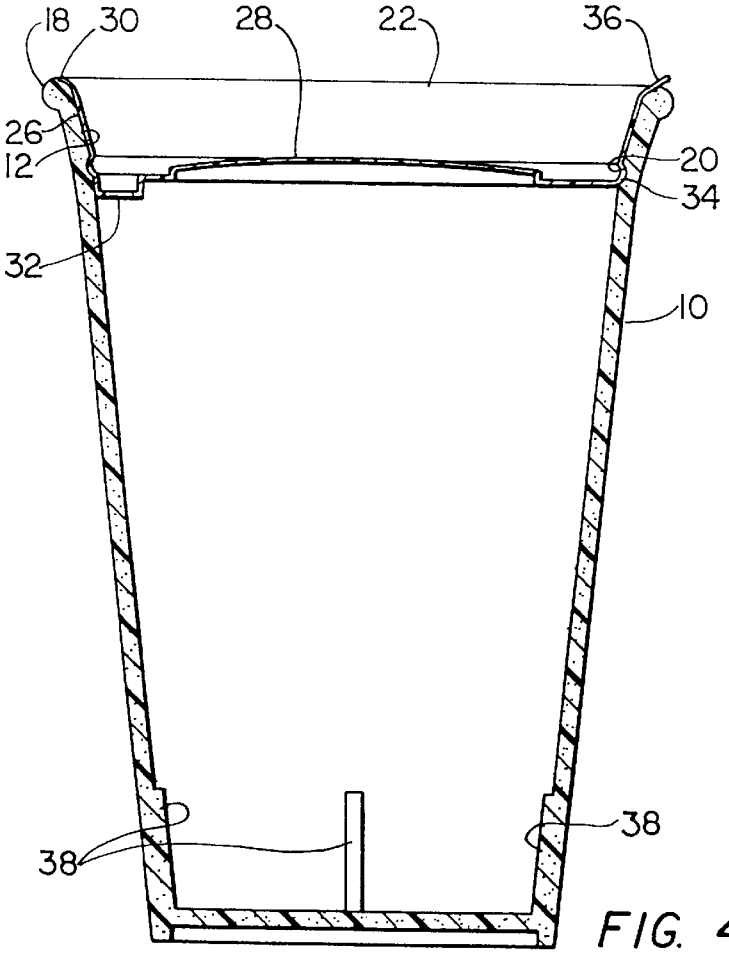
FIG. 4 is a sectional view of the cup and lid illustrated in FIG. 2.

Turning now to FIG. 4, a sectional view of the cup 10 and lid 22 of FIG. 2 is shown. In this view, the tight sealing arrangement between the locking ring 34 and groove 20, the inner face 12 of the cup and outer face 26 of the lid, and the lip 18 of the cup and lip 30 of the lid are clearly shown.

Continuing to refer to FIG. 4, the lip 18 of the cup is shown to be unencumbered and uncovered along its upper and outer face by the lip 30, with the exception of the tab 36, which extends slightly over the lip of the cup. Also in this view, the base 28 of the lid is shown to have a substantially convex bow at its center so the liquid is urged toward the outer edge of the base and toward the fluid port 32. In addition to providing good "lip feel," the outwardly rolled cup lip 18 imparts substantial radial integrity and stability to the cup.

Also shown in FIG. 4 are stacking ribs 38 that are integral with the inner face of the cup and extend upward from the base to provide a localized region within the cup having a reduced diameter.

Figure 5:
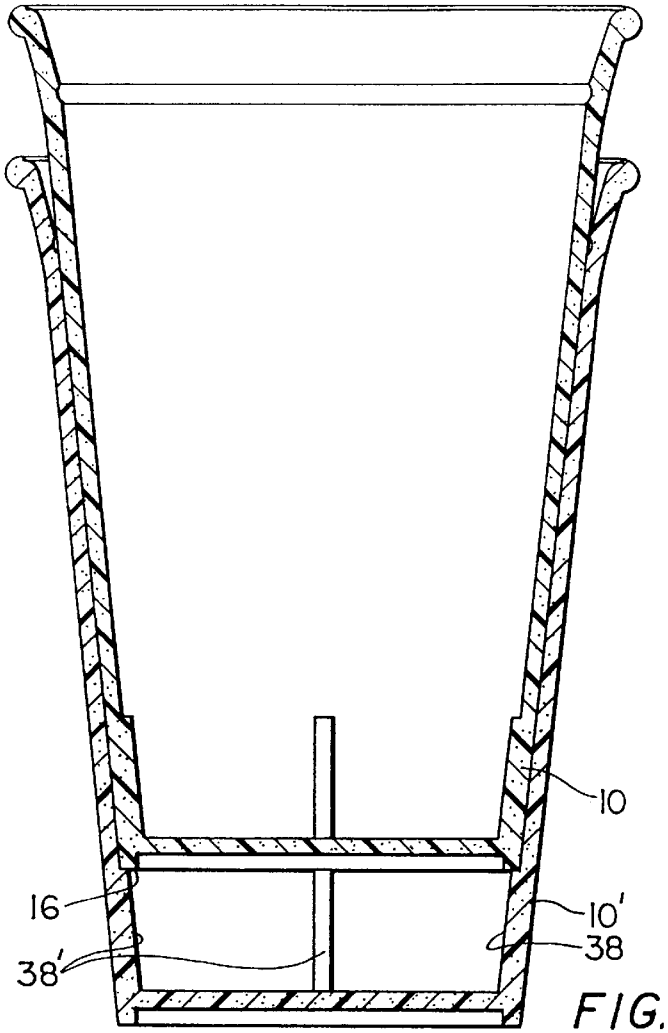
FIG. 5 is a sectional view of two cups in accordance with the invention, wherein a first cup is illustrated nested within a second cup.

FIG. 5 illustrates two cups 10 and 10' in cross-section wherein a first cup 10 is stacked or nested within a second cup 10'. In this view it will be noted that stacking ribs 38' on the second cup 10' engage a portion of the base 16 of the first cup 10, thereby preventing the first cup from being depressed within the second cup other than by a predetermined distance. Thus, the cups 10 and 10' are not wedged together which would render it difficult to extract one cup from the other. This is particularly important in a fast-service environment wherein a worker must be able to quickly and surely grasp a single cup without pulling either an entire stack or a partial stack along with the cup which would not only be inconvenient but also waste time.

Figure 6:
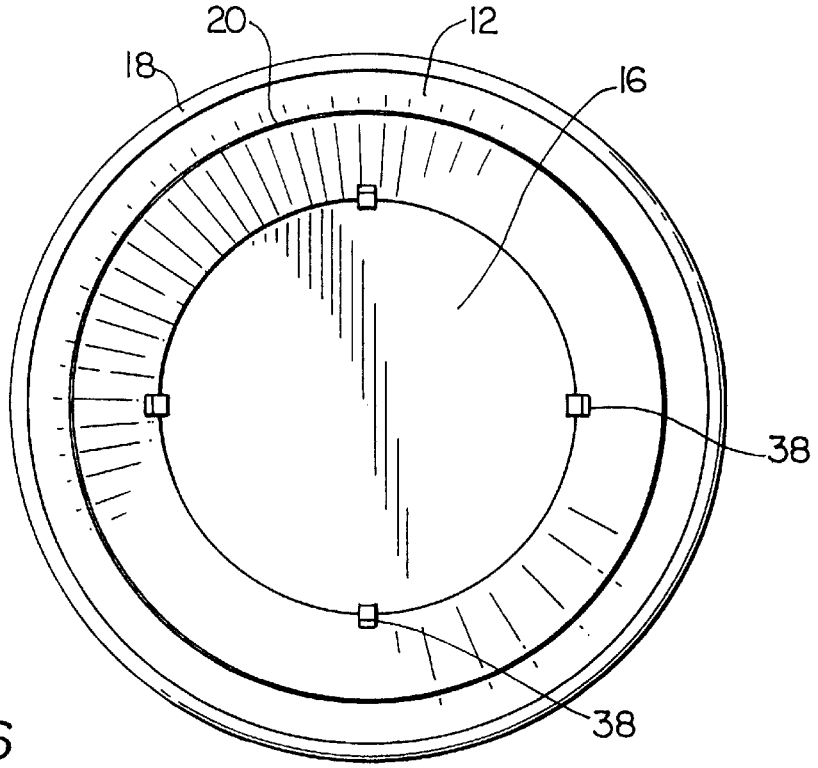
FIG. 6 is a top view of the inside of the cup of FIG. 1.

FIG. 6 is a view of the interior of the cup 10 illustrated in FIGS. 1–5 which shows the bottom of the cup 16, the tapered inner face 12, the locking groove 20, and the lip 18.

Figure 7:
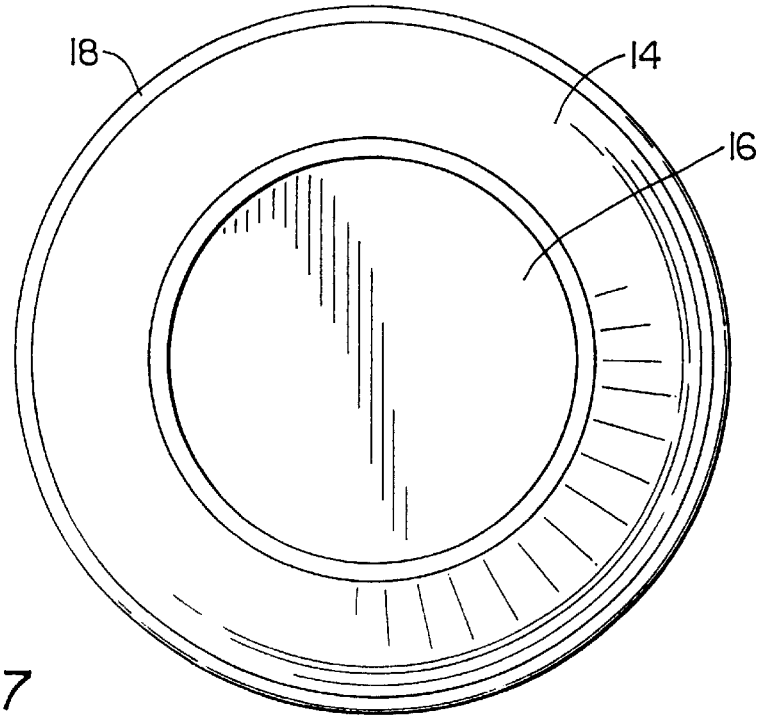
FIG. 7 is a bottom view of the cup of FIG. 1.

FIG. 7 is a bottom view of the cup illustrated in FIGS. 1–6, wherein the bottom of the cup 16, the outer face 14, and the lip roll 18 are visible.

Figure 8:
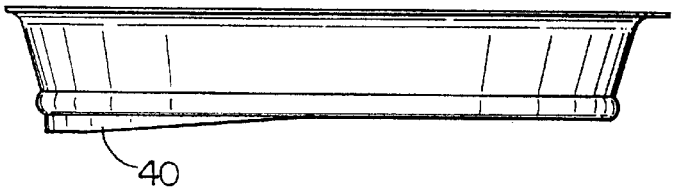
FIG. 8 is a side view of a lid in accordance with the invention.
Figure 9:
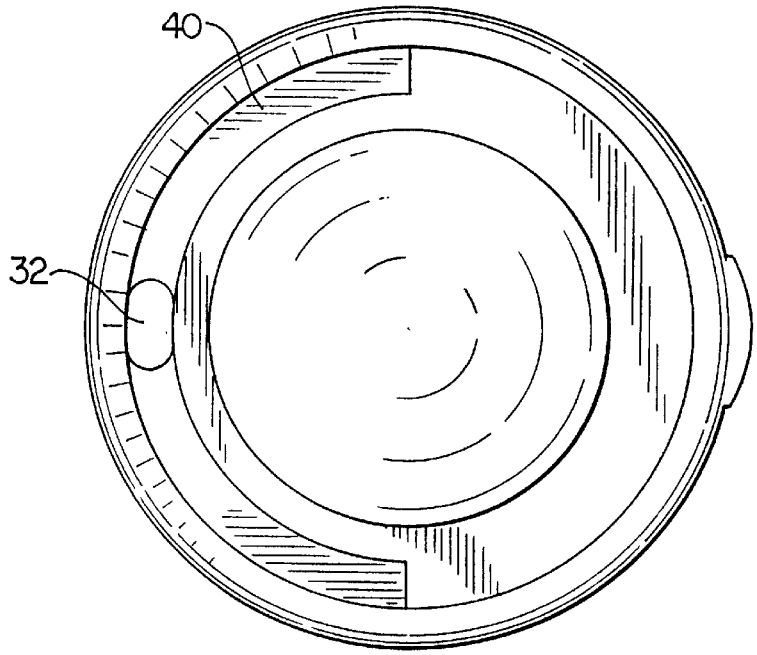
FIG. 9 is a top view of the lid of FIG. 8.
Figure 10:
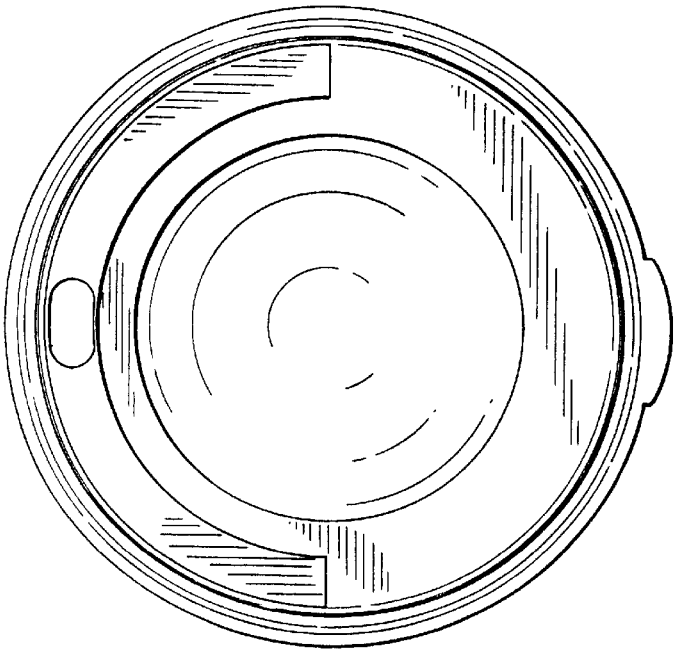
FIG. 10 is a bottom view of the lid of FIG. 8.
Figure 11:
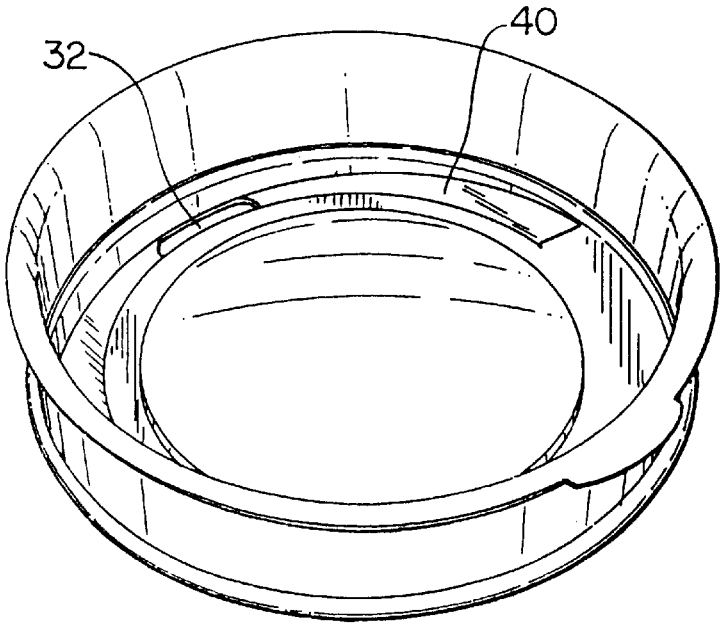
FIG. 11 is a perspective view of the lid of FIG. 8.

FIG. 8 is a side view of an alternative embodiment of a lid in accordance with the invention. FIG. 9 is a top view of the lid of FIG. 8, and FIG. 10 is a bottom view of the lid of FIG. 8. With respect to FIG. 8 it should be noted that a portion of the base of the lid is depressed at one point along the region of the base/wall intersection to define a fluid channel 40 as shown in FIG. 8. As described above, this and the other lids of the invention are configured to not only create a "nose well" but to also urge coffee back into the cup. FIG. 11 is a perspective view of the lid of FIGS. 8–10.

Figure 12:
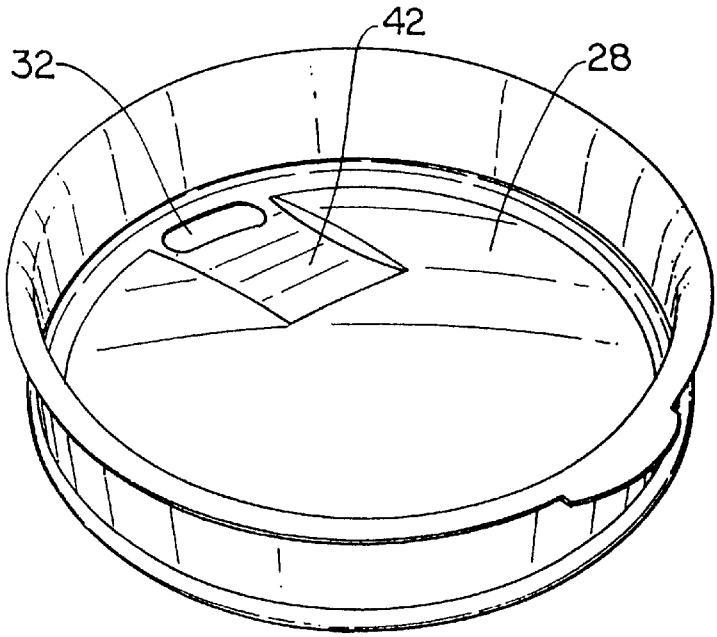
FIG. 12 is a perspective view of an alternative embodiment of the lid of the invention.
Figure 16:
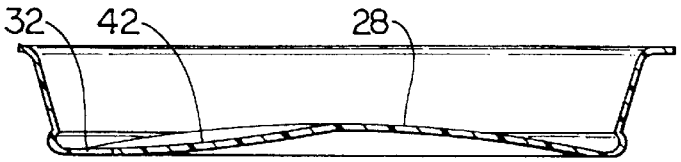
FIG. 16 is a sectional view of the lid of FIG. 12.
Figure 15:
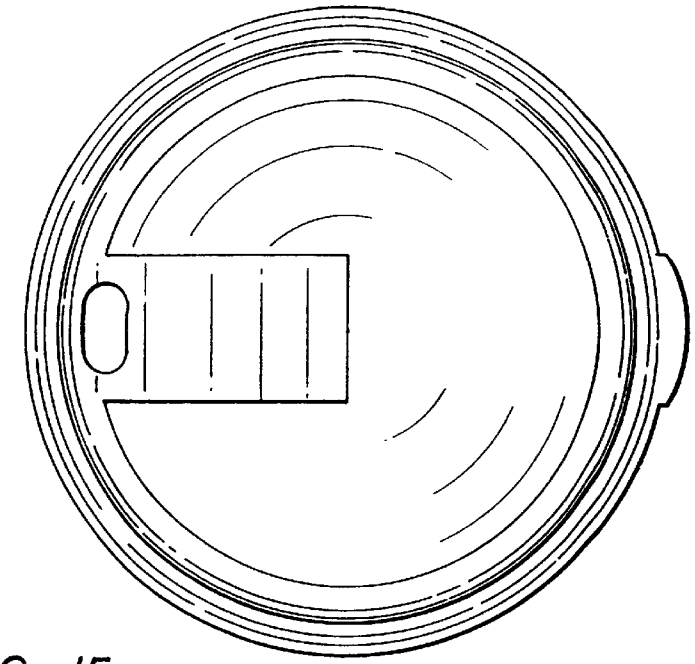
FIG. 15 is a bottom view of the lid of FIG. 12.
Figure 13:
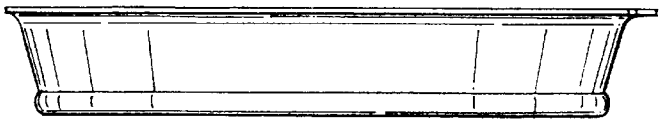
FIG. 13 is a side view of the lid of FIG. 12.
Figure 14:
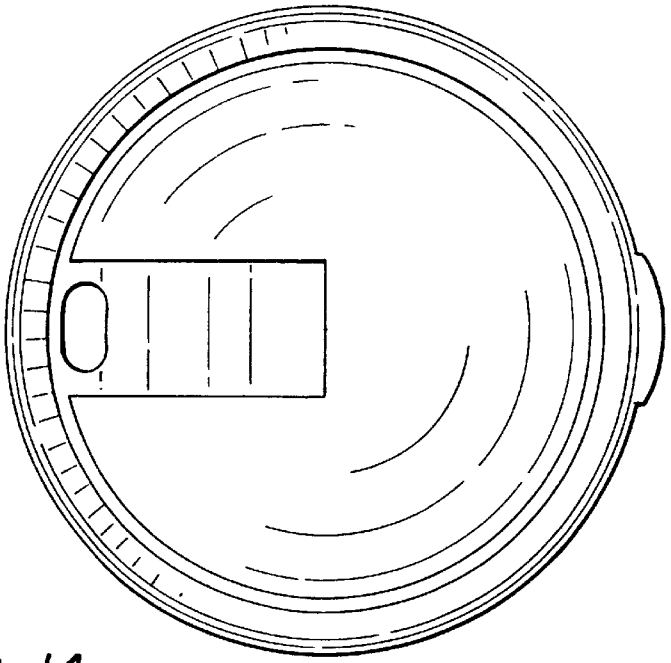
FIG. 14 is a top view of the lid of FIG. 12.

FIG. 12 is a perspective view of another embodiment of a lid, wherein a convex base portion 28 includes a sloped ramp 42 or channel which leads toward the fluid port 32. FIG. 13 is a side view of the lid shown in FIG. 12. FIG. 14 is a top view of the lid in FIG. 12, and FIG. 15 is a bottom view of the lid in FIG. 12. FIG. 16 is a sectional view of the lid shown in FIG. 12, wherein the convex surface of the base 28 is clearly shown as is the ramp 42 leading to the fluid port 32.

Figure 17:
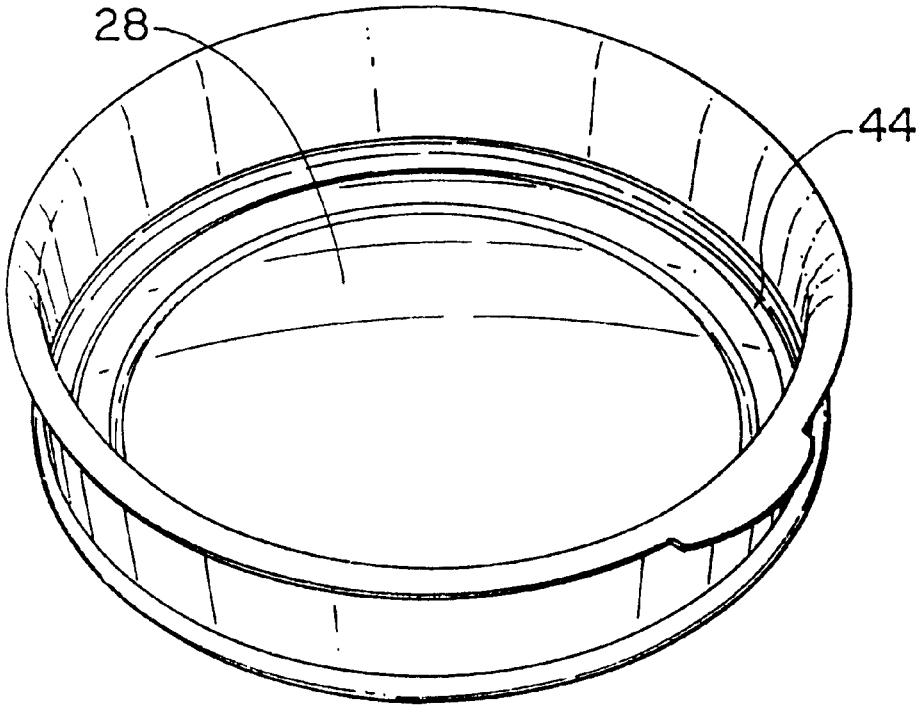
FIG. 17 is a perspective view of yet another embodiment of the lid.
Figure 21:
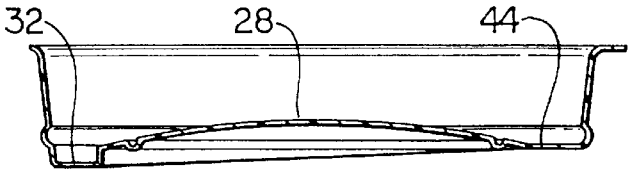
FIG. 21 is a sectional view of the lid of FIG. 17.
Figure 20:
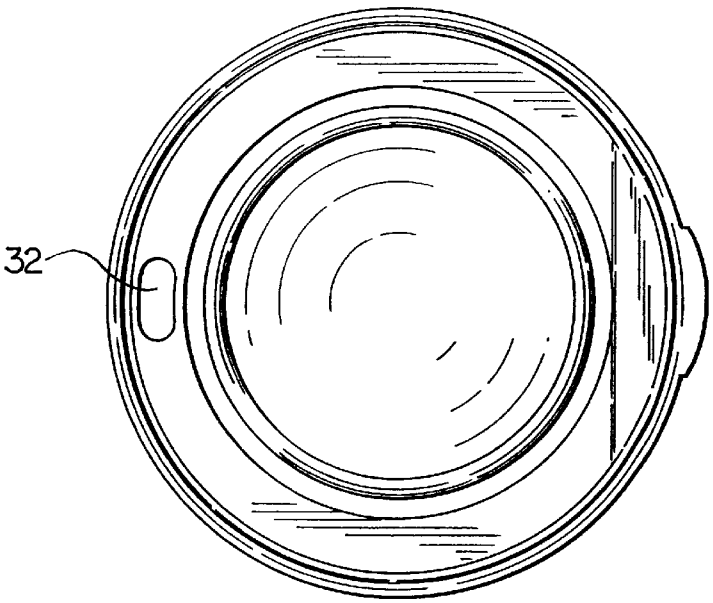
FIG. 20 is a bottom view of the lid of FIG. 17.
Figure 18:
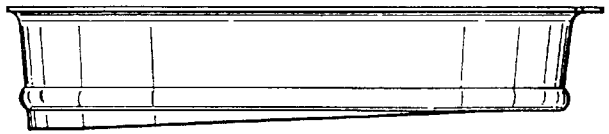
FIG. 18 is a side view of the lid of FIG. 17.
Figure 19:
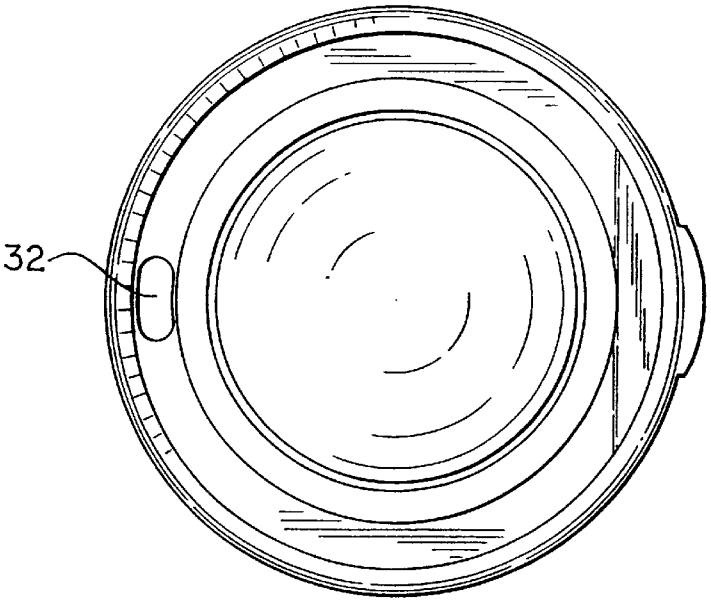
FIG. 19 is a top view of the lid of FIG. 17.

FIG. 17 is a perspective view of yet another embodiment of a lid in accordance with the invention. In this embodiment a convex lid base 28 urges liquid deposited thereon into a circumferential channel 44 which directs fluid into a fluid port which is not visible in this view as it is obscured by the convex surface of the lid base. FIG. 18 is a side view of the lid of FIG. 17, and FIGS. 19 and 20 are respective top and bottom views. In both FIGS. 19 and 20 the fluid port 32 is visible. FIG. 21 is a sectional view of the lid of FIG. 17 showing the convex portion of the lid base 28 and the circumferential channel 44 leading to the fluid port 32 which is slightly below the plane of the channel at a point opposite the fluid port.

In each of the above described embodiments of the lid, the fluid port 32 is always unobstructed so that a customer does not have to tear off, remove, fold or lock anything to access the beverage. Although not needed to prevent spill-over or splash, the lid can be provided with a device that seals the fluid port until the device is adjusted, moved, or manipulated by the user to allow or inhibit fluid flow to and from the fluid port. An important consideration for such a fluid port device is ease of use. FIGS. 22–35 illustrate embodiments of the lid including exemplary fluid port devices.

Figure 22:
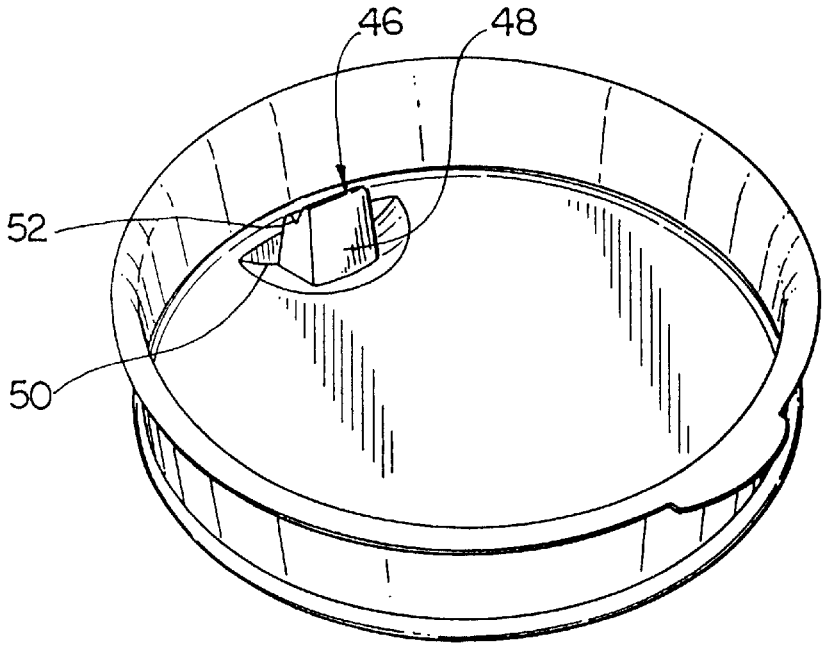
FIG. 22 is a perspective view of another embodiment of the lid in accordance with the invention having liquid port device in a first position.

FIG. 22 is a perspective view of a lid having a fluid port device 46 in a first or sealed position. The fluid port device 46 includes a protuberance 48 and a rupturable membrane or region 50 of the lid that has weakened tensile strength. The protuberance 48 can include a locking slot 52 to secure the fluid port device 46 in a second or open position. The protuberance 48 is also movable from the open position to the closed position to reseal the lid.

Figure 23:
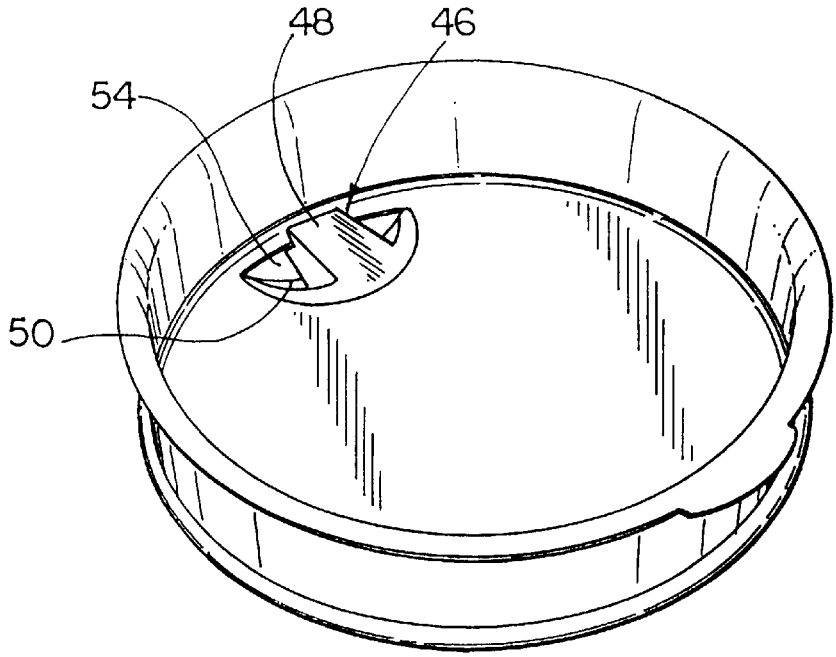
FIG. 23 is a perspective view of the lid of FIG. 22 showing the liquid port device in a second position.

FIG. 23 illustrates the protuberance 48 bent or pushed toward the base of the lid to transition the fluid port device 46 from the first position to the second position. As the protuberance 48 is moved, the weakened region 50 of the lid tears or separates to provide a fluid port 54 or fluid passage through the lid. The locking slot engages a portion of the lid to impede further downward movement or return of the protuberance 58 toward the first position.

Figure 27:
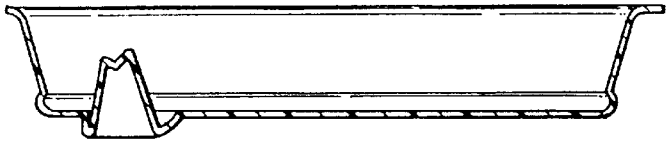
FIG. 27 is a sectional view of the lid of FIG. 22.
Figure 26:
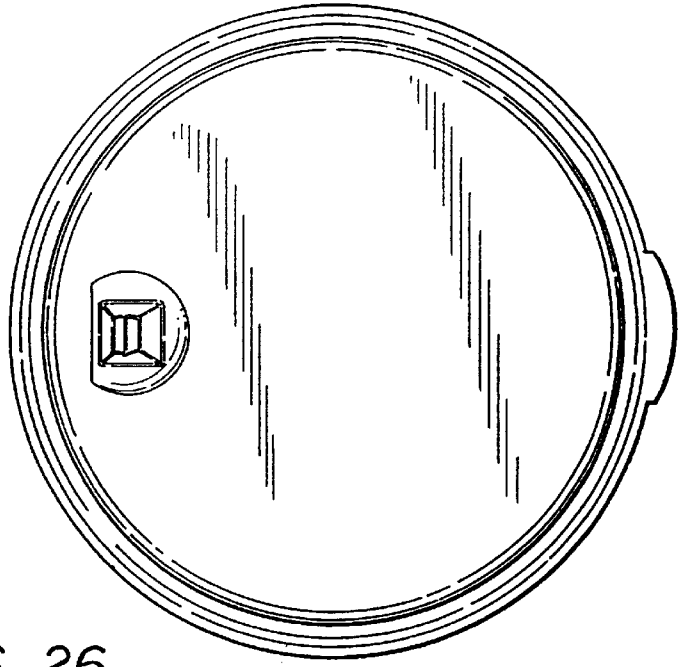
FIG. 26 is a bottom view of the lid of FIG. 22.
Figure 24:
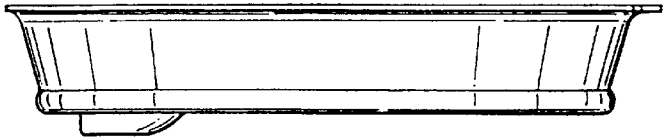
FIG. 24 is a side view of the lid of FIG. 22.
Figure 25:
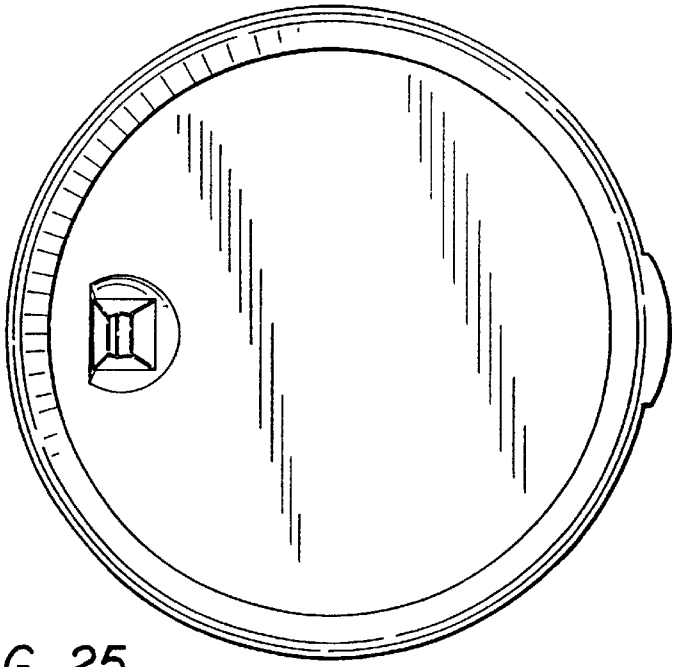
FIG. 25 is a top view of the lid of FIG. 22.
Figure 28:
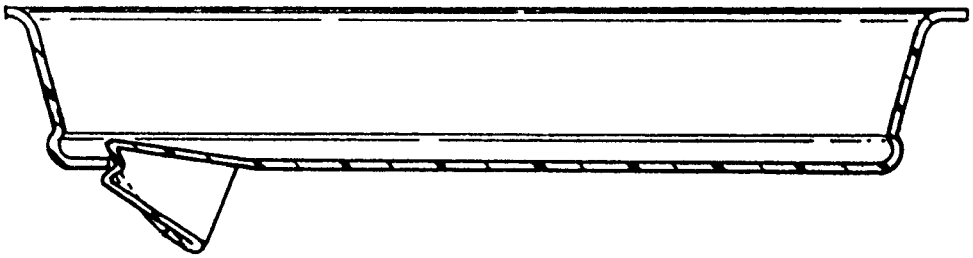
FIG. 28 is a sectional view of the lid of FIG. 23.

FIG. 24 is a side view of the lid illustrated in FIG. 22. FIGS. 25 and 26 are top and bottom views respectively of the lid shown in FIG. 22, wherein the fluid port device is in the first or closed position. FIG. 27 is a sectional view of the lid illustrated in FIG. 22, wherein the fluid port device is in the first or closed position. FIG. 28 is a sectional view of the lid illustrated in FIG. 23, wherein the fluid port device is in the second or open position.

Figure 29:
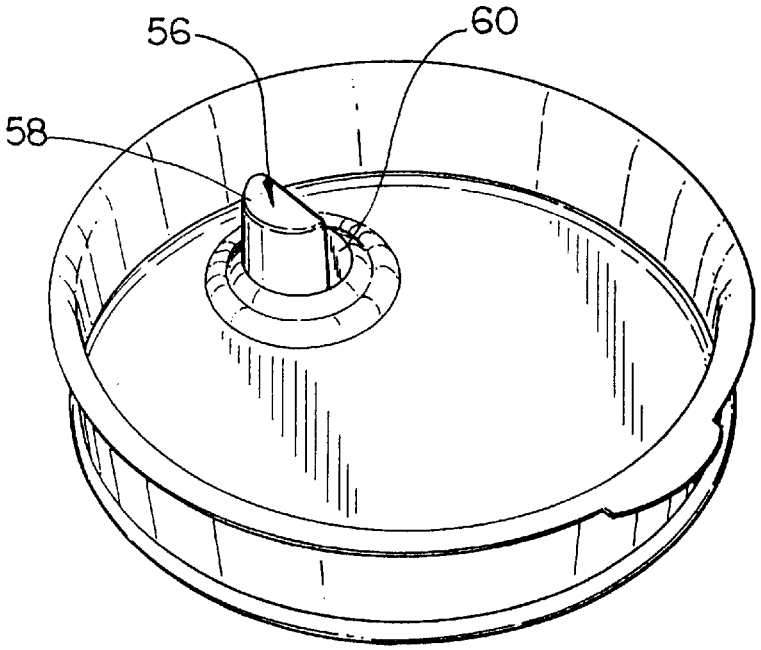
FIG. 29 illustrates still another embodiment of the lid, wherein the lid includes another embodiment of a liquid port device in a first position.

Another embodiment of the lid that includes an alternative embodiment of a fluid port device is illustrated in FIGS. 29–35. FIG. 29 is a perspective view of a lid having a fluid port device 56 in a first or sealed position. The fluid port device includes a protuberance 58 and a rupturable membrane or region 60 of the lid that has weakened tensile strength. The protuberance 58 can be locked into place to secure the fluid port device in a second or open position by material deformation around the protuberance.

Figure 30:
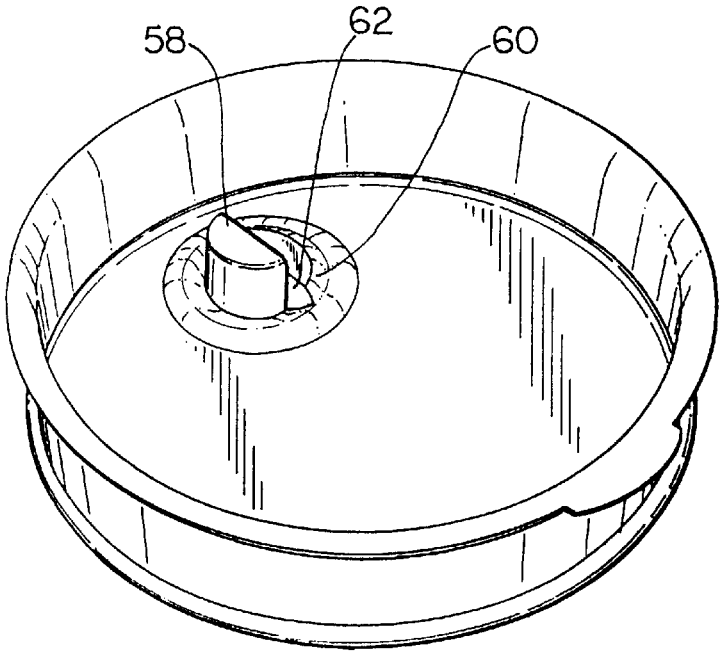
FIG. 30 is a perspective view of the lid of FIG. 29 showing the liquid port device in a second position.

FIG. 30 illustrates the protuberance 58 pushed down towards the base of the lid to transition the fluid port device 56 from the first position to the second position. As the protuberance 58 is moved, the weakened region 60 of the lid tears or separates to provide a fluid port 62 or fluid passage through the lid. The material around the protuberance 58 deforms to a limited extent to impede further downward movement or return of the protuberance toward the first position.

Figure 34:
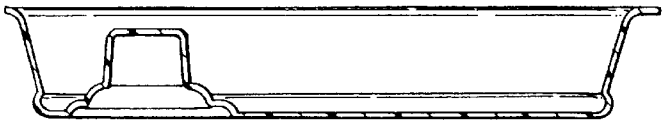
FIG. 34 is a sectional view of the lid of FIG. 29.
Figure 33:
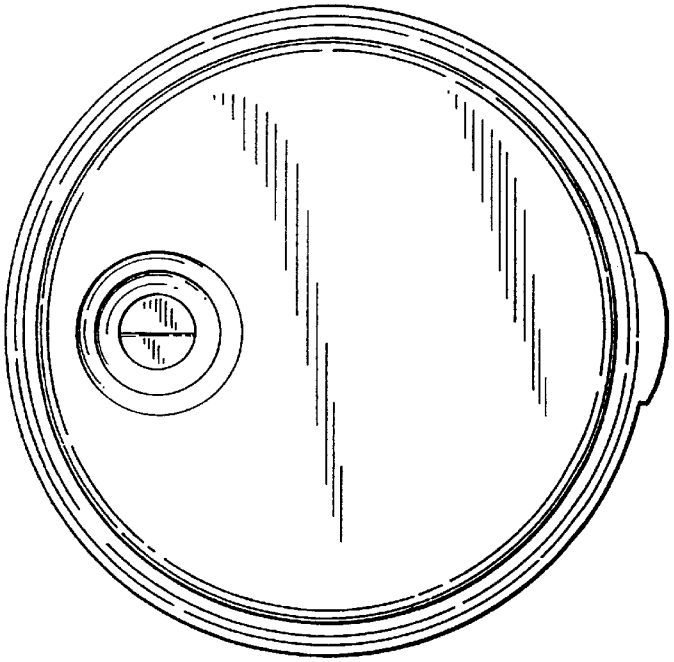
FIG. 33 is a bottom view of the lid of FIG. 29.
Figure 31:
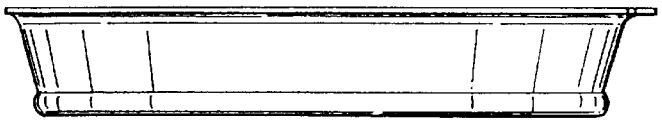
FIG. 31 is a side view with the lid of FIG. 29.
Figure 32:
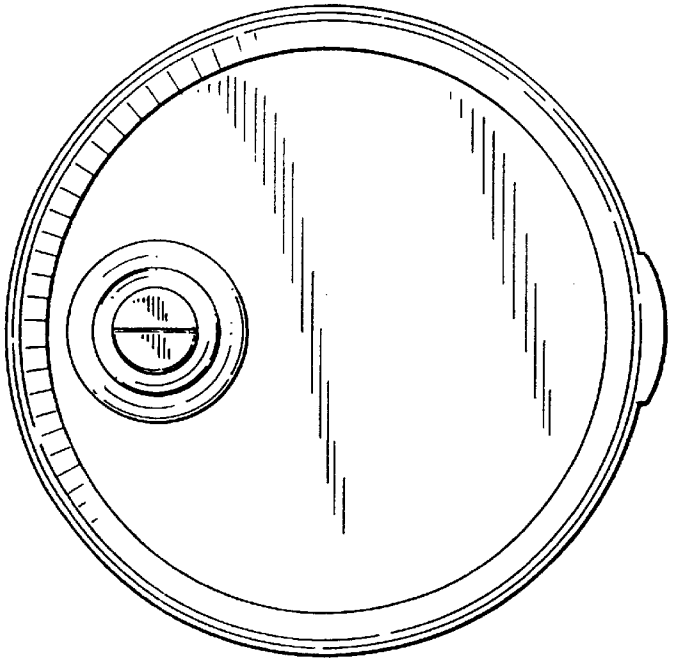
FIG. 32 is a top view of the lid of FIG. 29.
Figure 35:
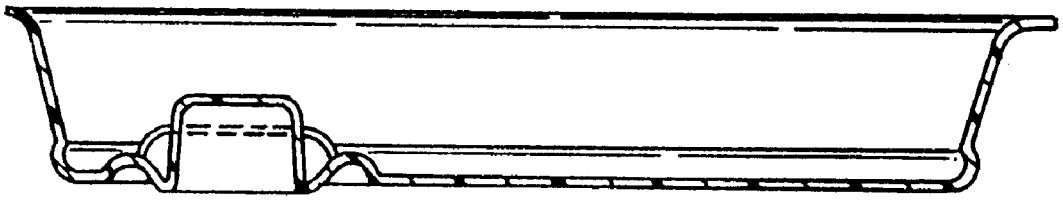
FIG. 35 is a sectional view of the lid of FIG. 30.

FIG. 31 is a side view of the lid of FIGS. 29 and 30. FIGS. 32 and 33 are top and bottom views, respectively, of the lid of FIG. 29. FIG. 34 is a sectional view of the lid in FIG. 29 illustrating the fluid port device in the first or closed position. FIG. 35 is a sectional view of the lid illustrated in FIG. 30, wherein the fluid port device is in the second or open position. In this embodiment of the lid, a bi-stable geometry allows the fluid port to be opened or closed by pressing or "popping" the protuberance.

Figure 36:
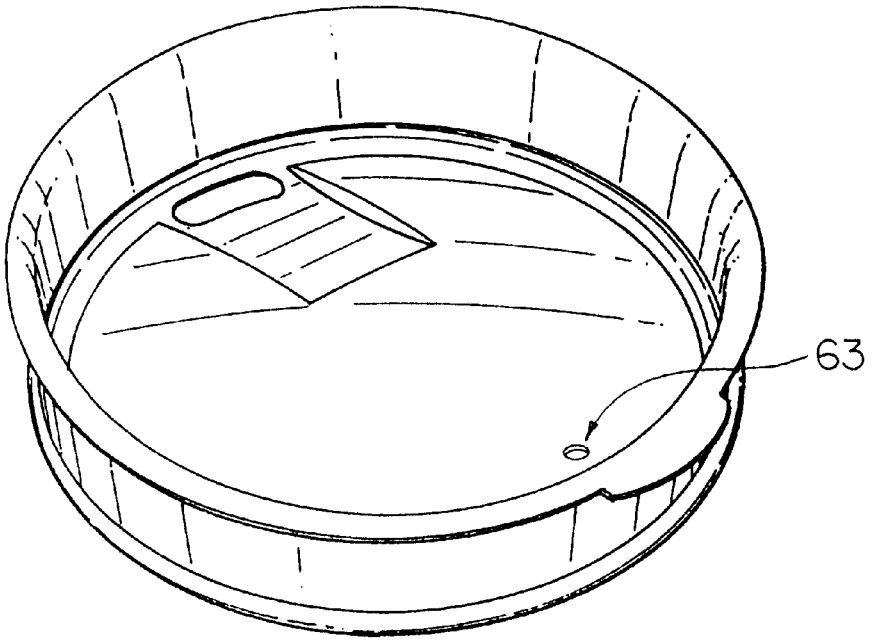
FIG. 36 is a perspective view of a lid according to the invention that includes a vent.
Figure 37:
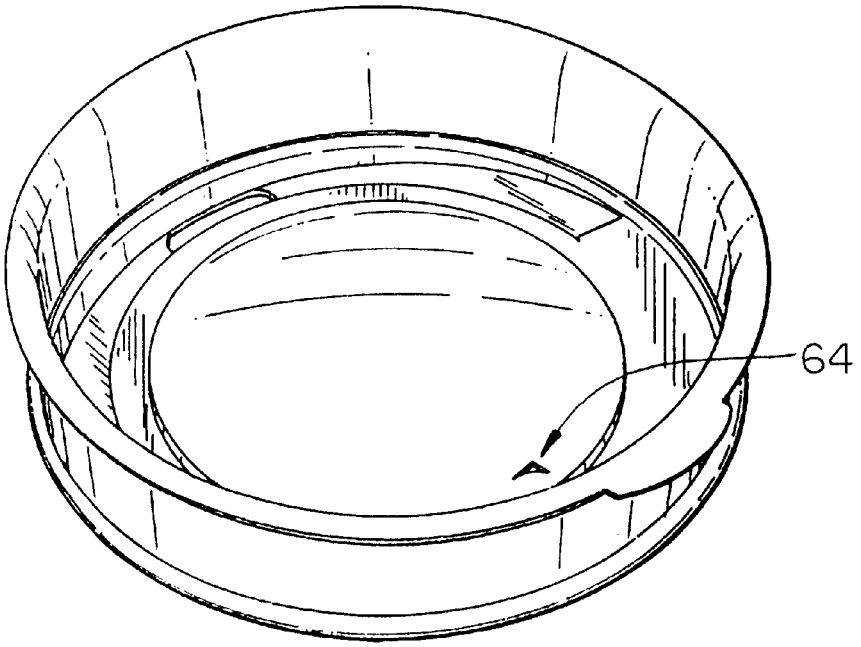
FIG. 37 is a perspective view of another lid according to the invention that includes a different vent.

Although not illustrated in the preceding figures, it should be appreciated that any of the lid configurations can include a vent or hole in the lid for steam venting and/or pressure equalization. FIG. 36, for example, is a perspective view of a lid according to the invention that includes a vent 63 that is a substantially circular punched hole. FIG. 37 is a perspective view of another lid according to the invention that includes a vent 64 that is a chevron shaped lanced hole. Other geometries for the vent are possible.

Figure 38:
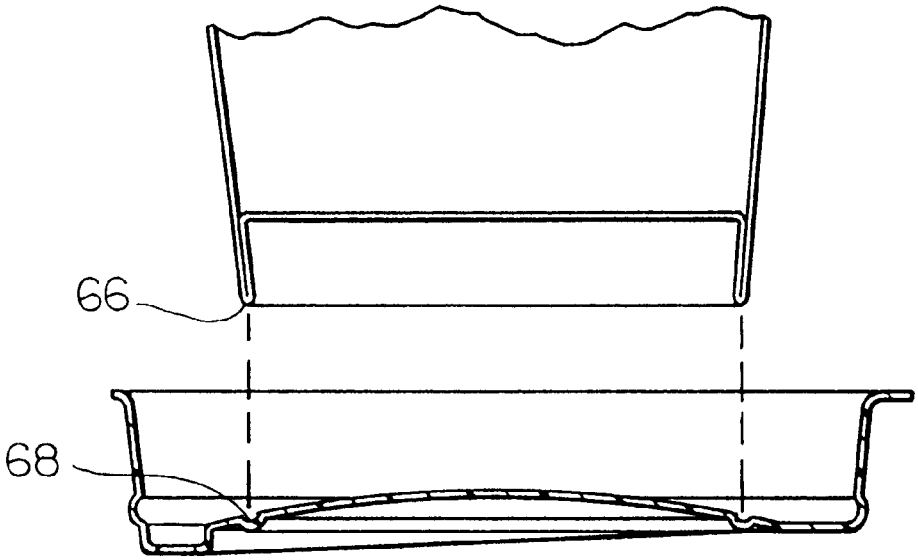
FIG. 38 is a sectional view of a cup and lid that includes stacking features in accordance with the invention.

FIG. 38 illustrates yet another feature of the invention, wherein the base of a cup 66 has a diameter and shape corresponding to that of a circular groove 68 in the base of a lid. This feature allows stacking of covered cups.

Figure 39:
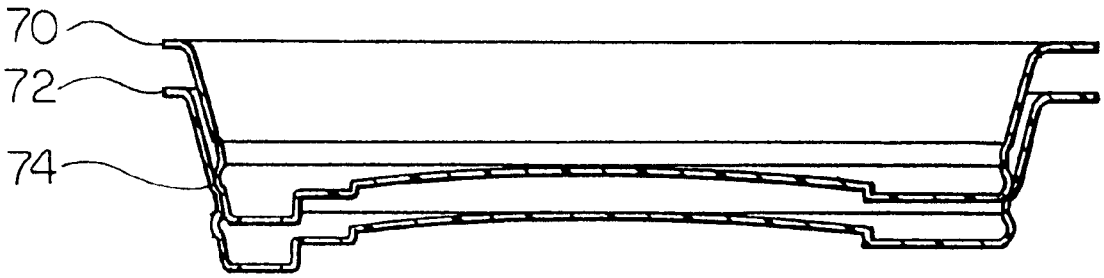
FIG. 39 is a sectional view of nested lids in accordance with the invention.

FIG. 39 illustrates yet another feature of the invention, wherein a first lid 70 is nested within a second lid 72. A locking ring 74 of the first lid engages the tapered inner wall of the second lid to prevent the lid bases from making contact.

Figure 40:
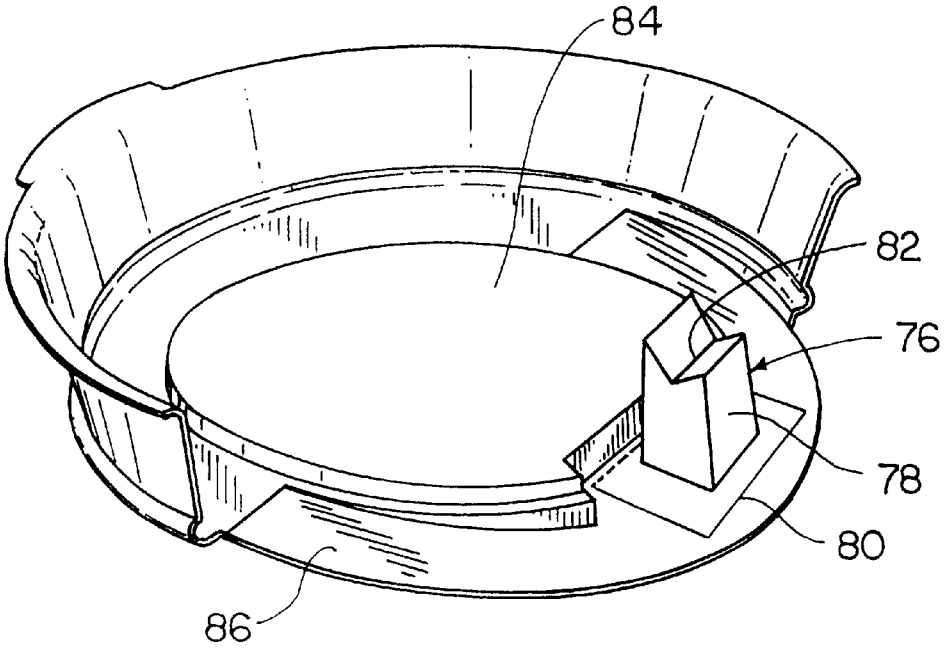
FIG. 40 is a partial cut-away view of yet another lid in accordance with the invention showing a liquid port device in a first position.

FIG. 40 is a perspective view of yet another embodiment of a lid in accordance with the invention. The lid includes a fluid port device 76 in a first or sealed position. The fluid port device 76 includes a protuberance 78 and a rupturable membrane or region 80 of the lid that has weakened tensile strength. The protuberance 78 can include a locking slot 82 to secure the fluid port device 76 in a second or open position. The protuberance 78 is also movable from the open position to the closed position to reseal the lid. This embodiment of the lid includes a raised center portion 84 that can be substantially flat as shown or convex. The diameter of the raised center portion 84 corresponds to the diameter of the recessed bottom portion of the cup to facilitate stacking a second cup on the lid of a covered first cup. The lid also includes a circumferential inclined portion 86 that urges coffee on the top of the lid toward the fluid port device 76.

Figure 41:
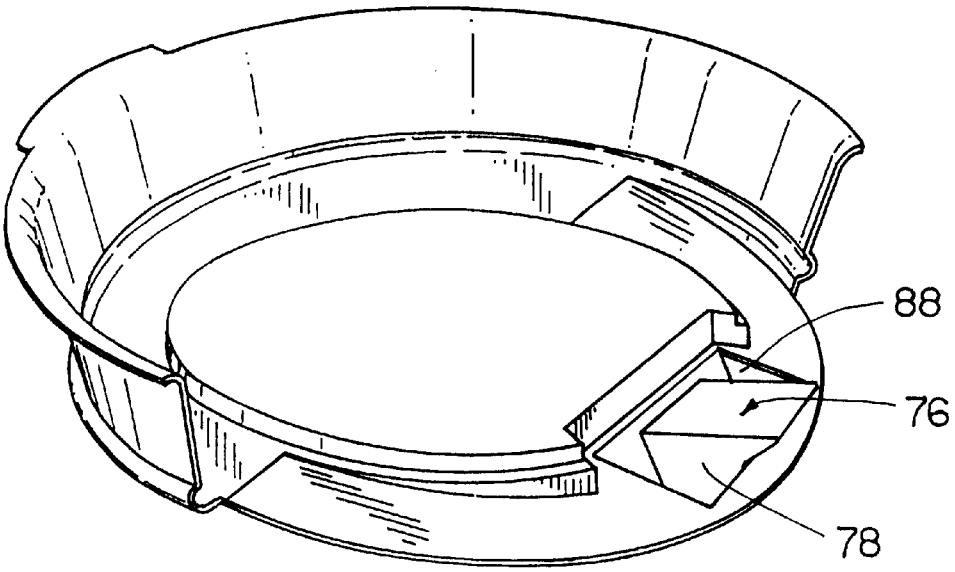
FIG. 41 is a partial cut-away view of the lid of FIG. 40 showing the liquid port device in a second position.

FIG. 41 illustrates the protuberance 78 bent or pushed toward the base of the lid to transition the fluid port device 76 from the first position to the second position. As the protuberance 78 is moved, the weakened region 80 of the lid tears or separates to provide a fluid port 88 or fluid passage through the lid. The locking slot engages a portion of the lid to impede further downward movement or return of the protuberance 78 toward the first position.

Although the invention has been shown and described with respect to exemplary embodiments thereof, various other changes, omissions, and additions in form and detail thereof may be made therein without departing from the spirit and scope of the invention.

What is claimed is:

1. A cup assembly comprising:

cup comprising:

a resilient, hollow, frustroconical body open at a first end and closed at a second end, said first end having a greater diameter than said second end, said body including a wall having an inner face and an outer face, said wall extending from said first end to said second end, the outer face of said wall having a first linear portion extending from said second end to an intermediate wall point and a second linear portion extending from said intermediate wall point to said first end, said second linear portion being angled outward more than said first linear portion, said wall having an beaded lip at said open first end, and a groove subjacent to said beaded lip and inscribed in said inner face of said wall; and a lid comprising:

a resilient, hollow, frustroconical body open at a first end and closed at a second end, wherein said first end has a greater diameter than said second end, and wherein said body includes a wall having an inner face and an outer face, said wall extending from said first end to said second end, and said wall having an outwardly flared lip at said open first end, said lip of said lid having a diameter that is less than the diameter of said open first end of said cup;

a locking ring on said lid subjacent to said outwardly flared lip, said locking ring adapted for insertion into said groove of said cup;

said closed second end of said lid defining a fluid port; and wherein said second linear portion of said wall of said cup has a length substantially equal to the height of said lid, wherein a substantially uniform fluid tight seal is provided between said lid and said cup when said lid is mated with said cup and wherein the lip of the lid covers only a portion of an inner face of the beaded lip of the cup.

2. The cup assembly of claim 1, wherein said cup further comprises a plurality of stacking ribs integral with the inner face of said wall and which project into said open body.

3. The cup assembly of claim 1, wherein said cup consists of beaded foam.

4. The cup assembly of claim 1, wherein said closed second end of said lid includes a convex surface and said fluid port is lower than said convex surface.

5. The cup assembly of claim 4, wherein said closed second end of said lid further includes a channel providing a path to said fluid port.

6. The cup assembly of claim 5, wherein said channel is inclined.

7. The cup assembly of claim 6, wherein said convex surface is at least partially surrounded by said channel and said channel is lower than said convex surface.

8. The cup assembly of claim 1, wherein said fluid port comprises a fluid port device moveable from a first position to a second position to provide a fluid passage through said lid.

9. The cup assembly of claim of claim 8, wherein said fluid port device comprises a protuberance that extends upward within said lid in said first position, and wherein said lid includes a region of weakened tensile strength proximate said protuberance.

10. The cup assembly of claim 8, wherein movement of said protuberance from said first position to said second position causes said region of weakened tensile strength to fail.

11. The cup assembly of claim 10, wherein said protuberance comprises a locking slot engagable with a portion of said lid.

12. The cup assembly of claim 1, wherein said closed second end of said lid includes a circular groove having a shape and a diameter and wherein said cup includes a base portion having a shape and a diameter corresponding to said shape and said diameter of said circular groove.

13. The cup assembly of claim 1 wherein an edge of said lip of said lid is recessed.

14. The cup assembly of claim 1 wherein said lip of said lid has a thickness such that the junction between the edge of the lip of the lid and the rolled lip of the cup is substantially smooth.

15. A cup assembly comprising a resilient, hollow, frustroconical body open at a first end and closed at a second end, said first end having a greater diameter than said second end, said body including a wall having an inner face and an outer face, said wall extending from said first end to said second end, the outer face of said wall having a first linear portion extending from said second end to an intermediate wall point and a second linear portion extending from said intermediate wall point to said first end, said second linear portion being angled outward more than said first linear portion, said wall having an beaded lip at said open first end, a plurality of stacking ribs integral with the inner face of said wall and which project into said open body, a groove subjacent to said beaded lip and inscribed in said inner face of said wall; and a lid including a resilient, hollow, frustroconical body open at a first end and closed at a second end, said lid having a height, said first end having a greater diameter than said second end, said body including a wall having an inner face and an outer face, said wall extending from said first end to said second end, and said wall having an outwardly flared lip at said open first end, a locking ring subjacent to said outwardly flared lip, said locking ring adapted for insertion into said groove of said cup, said closed second end of said lid defining a fluid port, and said lip of said lid having a diameter that is less than the diameter of said open first end of said cup and wherein said second linear portion of said wall has a length substantially equal to a height of said lid, wherein a substantially uniform fluid tight seal is provided between said lid and said cup when said lid is mated with said cup, and wherein the lip of the lid only covers a portion of the inner face of the beaded lip of the cup.

16. The cup assembly of claim 15, wherein said closed second end of said lid includes a convex surface, said fluid port being lower than said convex surface, and further including an inclined channel providing a path to said fluid port.

17. The cup assembly of claim 16, wherein said fluid port comprises a fluid port device moveable from a first position to a second position to provide a fluid passage through said lid, said fluid port device comprises a protuberance that extends upward within said lid in said first position, said lid includes a region of weakened tensile strength proximate said protuberance, and wherein movement of said protuberance from said first position to said second position causes said region of weakened tensile strength to fail.

18. The cup assembly of claim 17, wherein said fluid port device is movable from said second position to said first position to close said fluid passage through said lid.

* * * * *